US005325153A

United States Patent [19]

Mitsuse et al.

[11] Patent Number: 5,325,153

[45] Date of Patent: Jun. 28, 1994

[54] COLOR IMAGE FORMATION APPARATUS WITH DENSITY MEASUREMENT

[75] Inventors: Toshihiko Mitsuse; Yuuji Toyomura, both of Fukuoka, Japan

[73] Assignee: Matsushita Electric Industrial Co., Ltd., Japan

[21] Appl. No.: 31,124

[22] Filed: Mar. 12, 1993

[30] Foreign Application Priority Data

Mar. 19, 1992 [JP] Japan ..... 4-063700

[51] Int. Cl.[5] ..... G03G 15/00

[52] U.S. Cl. ..... 355/203; 355/326 R; 356/445

[58] Field of Search ..... 355/203, 208, 246, 271, 355/326, 326 R; 118/665, 691; 356/445

[56] References Cited

U.S. PATENT DOCUMENTS

| | | | |
|---|---|---|---|
| 4,111,151 | 9/1978 | Ruckdeschel | 355/208 Y |
| 5,103,260 | 4/1992 | Tompkins et al. | 355/208 |
| 5,173,750 | 12/1992 | Laukaitis | 356/445 |
| 5,200,783 | 4/1993 | Maeda et al. | 355/246 |

FOREIGN PATENT DOCUMENTS 63-177154 7/1988 Japan .

*Primary Examiner*—Joan H. Pendegrass
*Attorney, Agent, or Firm*—Parkhurst, Wendel & Rossi

[57] ABSTRACT

An image formation apparatus for forming a color image, having an image combining member for overlapping a plurality of different mono-color images formed by an electrophotographic process with a plurality of respective different colorants to form the color image thereon and a density measuring unit for measuring a reflective density at a desired portion of the color image, the density measuring unit having light emitting portion, such as a light emitting diodes, for emitting light toward the image combining member and a photoelectric conversion element, such as a phototransistor, for receiving and photoelectrically-converting the light reflected at the image combining member to a density signal, the plurality of colorants being divided into first and second groups, the first group of the plurality of different colorants having a higher reflectivity than the image combining member with respect to the light, a second group of the plurality of different colorants having a lower reflectivity than the image combining member comprises: a switching circuit for causing the light emitting portion to change an intensity of the light in response to an intensity control signal.

11 Claims, 7 Drawing Sheets

COLOR IMAGE FORMATION APPARATUS WITH DENSITY MEASUREMENT

BACKGROUND OF THE INVENTION

1. Field of the Invention

This invention relates to image formation apparatus for forming a color image, having a combining member for overlapping a plurality of different mono-color half tone or continuous tone images formed by an electrophotography process with a plurality of different colorants such as yellow, magenta, cyan, and black to form the color image thereon.

2. Description of the Prior Art

A color copy apparatus is known as a color image formation apparatus for forming a color image, having a combining member for overlapping a plurality of different mono-color half tone or continuous tone images formed by an electrophotography process with a plurality of different colorants such as yellow, magenta, cyan, and black to form the color image thereon. Such a prior art color copy apparatus comprises a photosensitive member, a charger for charging the photosensitive member, an optical system for consecutively forming and exposure each of primary color images and an achromatic color (black) image of half tone or continuous tone onto the charged photosensitive member to obtain electrostatic latent images, a developing system for consecutively developing the primary color images and the achromatic color image on the photosensitive member from the electrostatic latent images, and image combining member for receiving, overlapping, and combining each of primary colors and achromatic color images developed on the photosensitive member consecutively and a transfer unit for transferring the combined primary color and achromatic color images onto a paper for recording.

FIG. 4 is a side view of the prior art color image formation apparatus for showing a general structure which is common to the embodiment of this invention. FIG. 5 is a graph showing a general relation between an input image density and an output image density, that is a $\gamma$ characteristic, which is common to the embodiment of this invention. FIG. 6 is a block diagram of a prior art density measuring unit for measuring a reflective density of a portion of image formed on the combining member 6. FIG. 7 is a schematic circuit diagram of the prior art density measuring unit shown in FIG. 6. FIG. 8 is a graph showing relations between densities of input images of the primary colors and the achromatic color (black) image and output voltages of the prior art measuring unit 43 shown in FIG. 6.

In FIG. 4, a photosensitive member 1 formed in an endless belt is supported between rollers 2 and 3 with a suitable tension and rotated in the direction shown by an arrow A. An optical system 4 forms consecutively forming primary color images, such as yellow, magenta, and cyan, and an achromatic image, such as a black onto the photosensitive member 1 through electrophotographic process. During formation of the images, the photosensitive member 1 circulates and the optical system 4 scans a surface of the photosensitive member 1 with a laser beam to form a color image by forming each of primary color images and the black image on the photosensitive member 1 in phase with circulation of the photosensitive member 1. A charger 42 charges the photosensitive member 1 prior to exposure of each of primary color and black images. A developing system 5, having yellow, magenta, cyan, and black developers 5*y*, 5*m*, 5*c* and 5*b*, consecutively develops primary color images of yellow, magenta, cyan, and black image using colorants, such as toners, with correspondence to exposure of respective primary color images by the optical system 4. An image combining member 6 formed in an endless belt supported by roller 8, 9, and 10 with a suitable tension receives, overlapping and combining each of consecutively developed primary and achromatic color images. The image combining member 6 is circulated in the direction shown by an arrow B and its portion is contacted with a portion of the photosensitive member 1 to receive each of primary color and black images from the photosensitive member 6. The image combining member 6 combines primary color and black images by consecutively receiving the developed primary color and black images and transfer the combined color image to a paper 13 by the transferring unit 14.

It is possible to form a color image by combining primary color images, such as yellow, magenta, and cyan. However, generally, in order to improve a picture quality of color image, a black image of an achromatic color is added to the color image which has been formed by combining primary color images.

A density sensor 7 measures a density of a portion of a color image formed on the image combining member 6 by emitting a light and receiving a reflected light from the image combining member 6. The image combining member 6 has a intermediate reflectivity between those of colorants of primary colors and the achromatic color, i.e., black with respect to the emitted light. A position sensor 11 detects a reference marker, for example a hole provided to the image combining member 6 for generating position signals of the image combining member 6. The image combining member 6 combines primary color images and black image with reference to the position signals to match positions of primary color images and black image to reduce positional deviation. A paper 13 for recording is transported in the direction shown by an arrow C from a paper retainer 12 to a contacting portion between the roller 9 and a transferring unit 14 through a paper path 15. In operation, the charger 42 charges the photosensitive member 1 and then, the optical system 4 expose one of primary color and achromatic color images, for example yellow, with rotation of the photosensitive member 1. One of developers 5*y*, 5*m*, 5*c*, and 5*b*, develops the electrostatic latent image. For example the developer 5*y* develops a yellow image. Then the yellow image is transferred to the image combining member 6 from the photosensitive member 1. Then, the charger 42 charges the photosensitive member 1 again after cleaning and the optical system 4 exposes the next image onto the photosensitive member, for example a magenta image is exposed. The magenta image is developed as similar to the yellow image and then transferred to the image combining member 6 where the yellow image has been formed. A cyan image and black image are consecutively formed and combined on the image combining member 6. The combined color image is transferred to the paper 3 by the transferring unit 14. The order of formations of primary colors and achromatic color, i.e., black is predetermined in accordance with the quality of the formed color image or the like.

A density measuring unit 43 including the density sensor 7 measures a portion of each of primary color and black images formed on the image combining member 6.

Generally, the electrophotographic, or zerography processing is subjected to the various variations of the circumstances, such as the ambient temperature, humidity, or the like, so that difference in density or hue is developed in the resultant output image though the same picture image is formed. The graph shown in FIG. 5 represents a general relation between an input image density and an output image density. This relation is referred to as a $\gamma$ characteristic. Each of primary color images and the achromatic image has each $\gamma$ characteristic, so that the difference in density or hue is developed by the variation of the circumstance.

Therefore, it is possible to obtain a more stable output picture images by compensating the $\gamma$ characteristics of respective primary color and achromatic color images against the variation of the circumstance. The density measuring unit 43 is provided for detecting the density of a portion of the image combining member 6 in order to obtain the $\gamma$ characteristics and to compensate the quality of the resultant output picture image.

A control unit (not shown) including a microprocessor generates mono color and achromatic gray scale signals in response to position signals from the position sensor 11 and expose the photosensitive member 1 to an scanning light beam 44 to form gray scales of primary colors and achromatic color on the image combining member 6 and detects or samples a density signal of the density measuring unit 43 to measuring the density of the formed gray scales in response to the position signals from the position sensor 11.

As shown in FIG. 6, the density measuring unit 43 comprises a reference voltage generator 16 for generating a reference voltage Vr, a voltage-to-current converter 17 for converting the reference voltage to a reference current If, a light emitting portion 71 of the density sensor 7 for emitting an illumination light *7a* to a portion of the combining member 6, a photosensitive portion 72 of the density sensor 7 for receiving a light *7b* reflected at the image combining member 6 and producing a current signal Is in accordance with an intensity of the received light, a current-to-voltage converter 18 for converting the current signal Is to a voltage signal Vs, and an amplifier 19 for outputting a density signal Vo.

The reference voltage generator 16 generates the reference voltage Vr which determines the intensity of the reference current If for controlling a brightness of the illumination light *7a*. The voltage-to-current converter 17 converts the reference voltage to a reference current If. The density sensor 7 has the light emitting portion 71 and the photo-sensitive portion 72 in one. The light emitting portion 71 emits the illumination light *7a* to a desired portion of the image combining member 6. The image combining member 6 moves in the direction shown by an arrow D, so that when the illumination light *7a* hits a shadow portion *6a* of a gray scale, the photosensitive portion 72 receives the light reflected by the shadow portion *6a* of the gray scale. When the illumination light *7a* hits a bare portion of the combining member 6, the photosensitive portion 72 receives the light reflected at the image combining member 6. When the other intermediate density portion of the gray scale is illuminated, a portion of the illumination light is reflected by the colorant and the other portion of the illumination light is reflected by the surface of the image combining member 6. Therefore, the photosensitive portion 72 of the density sensor 7 detects the reflective density at the image combining member 6 by representing the current signal Is. The current-to-voltage converter 18 converts the current signal Is to a voltage signal Vs. The amplifier 19 outputs a density signal Vo to the control unit (not shown) to detect the $\gamma$ characteristics.

FIG. 7 shows the schematic diagram of the prior art density measuring unit 43. The reference voltage generator 16 comprises resistors 20 and 21 for dividing the supply voltage Vd to generate the reference voltage Vr. The voltage-to-current converter 17 comprises resistors 22, 23, 25, and 27, an operational amplifier 24, and a transistor 26 and determines the current signal If which is given by If=Vr/resistance of resistor 27. The current signal If determines the intensity of the illumination light *7a*.

The current-to-voltage converter 18 comprises resistors 28 and 29 outputs the voltage signal Vs given by Vs=Is×a resistance of the resistor 28. The amplifier 19 comprises resistors 30 and 31, and an operational amplifier 32 and outputs the density signal given by Vo=(1+resistance of the resistor 31/resistance of the resistor 30)×Vs.

The reference voltage Vr and the reflectivity of the image combining member 6 is determined as follows:

FIG. 8 shows the relation of a prior art between the density of input image signal (data) and the voltage of the density signal Vo. The colorants of primary color images shows a characteristic curve *8a* increasing from a reference point Vor with the density of input image signal, on the other hand the colorant of achromatic color shows a characteristic curve *8b* decreasing from the reference point Vor with the density of input image signal. The reference point Vor represents the reflectivity of the boar portion of the image combining member 6. That is, the colorants of the primary colors show higher reflectivities than the combining member 6 with respective to the wavelength of the illumination light *7a*. On the other hand, the colorants of the achromatic color shows a lower reflectivity than the image combining member 6. Therefore, the reference voltage Vr is determined such that the reference point Vor is positioned middle of the range of the characteristic curves *8a* and *8b*. That is, the intensity of the illumination light *7a* is determined by the reference voltage Vr in consider of the ranges of the characteristic curves *8a* and *8b*.

However, in the prior art image formation apparatus mentioned above, there is a problem that dynamic ranges of the characteristic curves *8a* of the primary colors and a dynamic rage of the achromatic color is smaller than the case that densities of primary colors and the density of achromatic color would be detected by different circuits. Therefore, the a resolution of density is low, so that fine density control was impossible and the picture quality was not suitably improved.

SUMMARY OF THE INVENTION

The present invention has been developed in order to remove the above-described drawbacks inherent to the conventional image formation apparatus with density measurement.

According to the present invention there is provided an image formation apparatus for forming a color image, having an image combining member for overlapping a plurality of different mono-color images formed by an electrophotographic process with a plurality of respective different colorants to form the color image thereon and a density measuring unit for measuring a reflective density at a desired portion of the color image, the density measuring unit having light emitting portion, such as a light emitting diodes, for emitting light toward the image combining member and a photoelectric conversion element, such as a phototransistor, for receiving and photoelectrically-converting the light reflected at the image combining member to a density signal, the plurality of colorants being divided into first and second groups, the first group of the plurality of different colorants having a higher reflectivity than the image combining member with respect to the light, a second group of the plurality of different colorants having a lower reflectivity than the image combining member comprising: a switching circuit for causing the light emitting portion to change an intensity of the light in response to an intensity control signal.

According to the present invention there is also provided an image formation apparatus for forming a color image, having an image combining member for overlapping a plurality of different mono-color images formed by an electrophotographic process with a plurality of respective different colorants to form the color image thereon and a density measuring unit for measuring a reflective density at a desired portion of the color image, the density measuring unit having a light emitting portion, such as a light emitting diode, for emitting light toward the image combining member and a photoelectric conversion element, such as a phototransistor, for receiving and photoelectrically-converting the light reflected at the image combining member to a density signal, the plurality of colorants being divided into first and second groups, the first group of the plurality of different colorants having a higher reflectivity than the image combining member with respect to the light, a second group of the plurality of different colorants having a lower reflectivity than the image combining member comprising: a switching circuit for causing the light emitting portion to change an intensity of the light between first and second values an intensity control signal such that in response to an intensity control signal the light emitting portion changes the intensity to the first value when a density of an image formed with one of colorant of the first group is measured by the density measuring unit and to a second value when a density of an image formed with one of colorant of the second group is measured by the density measuring unit.

BRIEF DESCRIPTION OF THE DRAWINGS

The object and features of the present invention will become more readily apparent from the following detailed description taken in conjunction with the accompanying drawings in which.

The same or corresponding elements or parts are designated as like references throughout the drawings.

DETAILED DESCRIPTION OF THE INVENTION

Hereinbelow will be described an embodiment of this invention.

Figure 1:
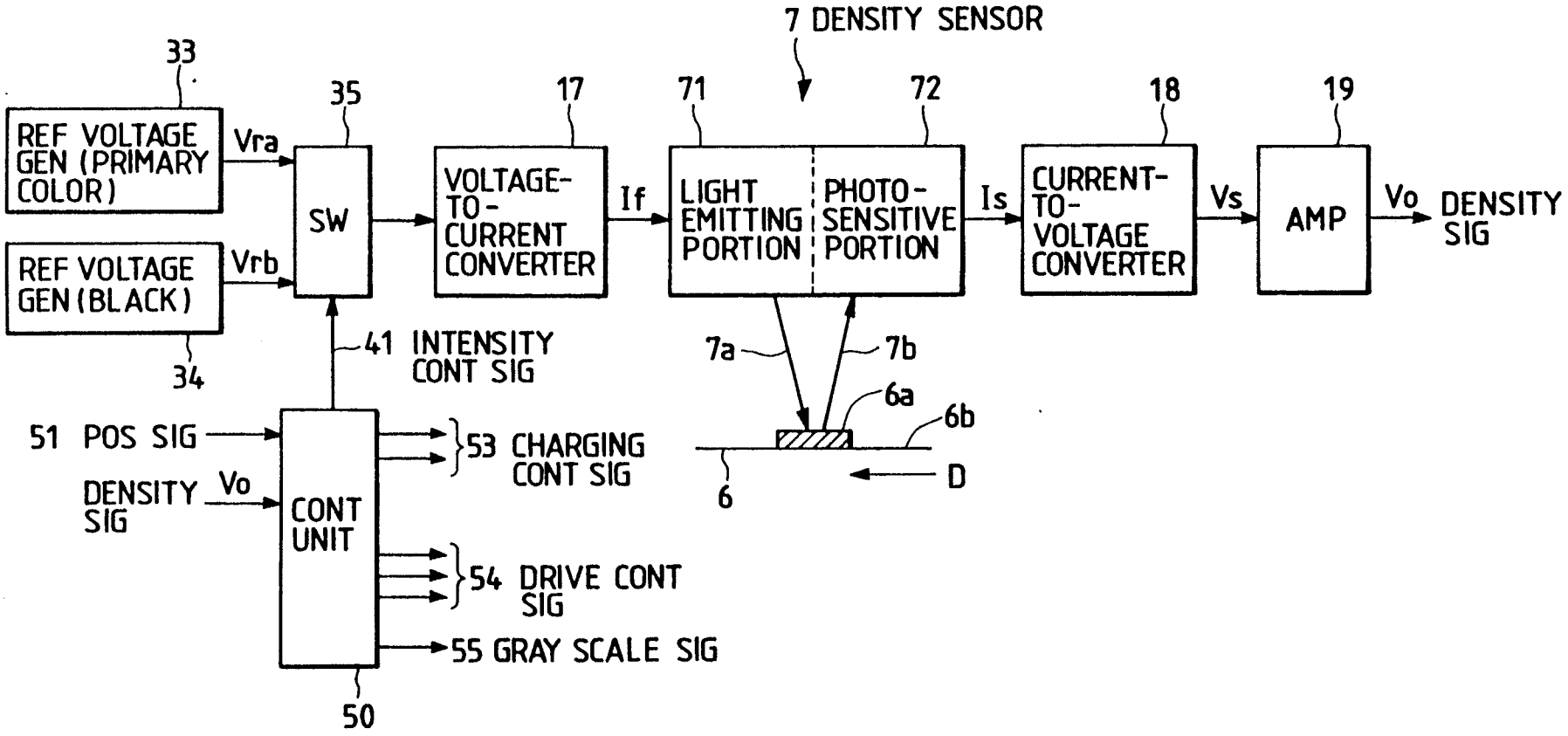
FIG. 1 is a block diagram of a density measuring unit of this embodiment.
Figure 2:
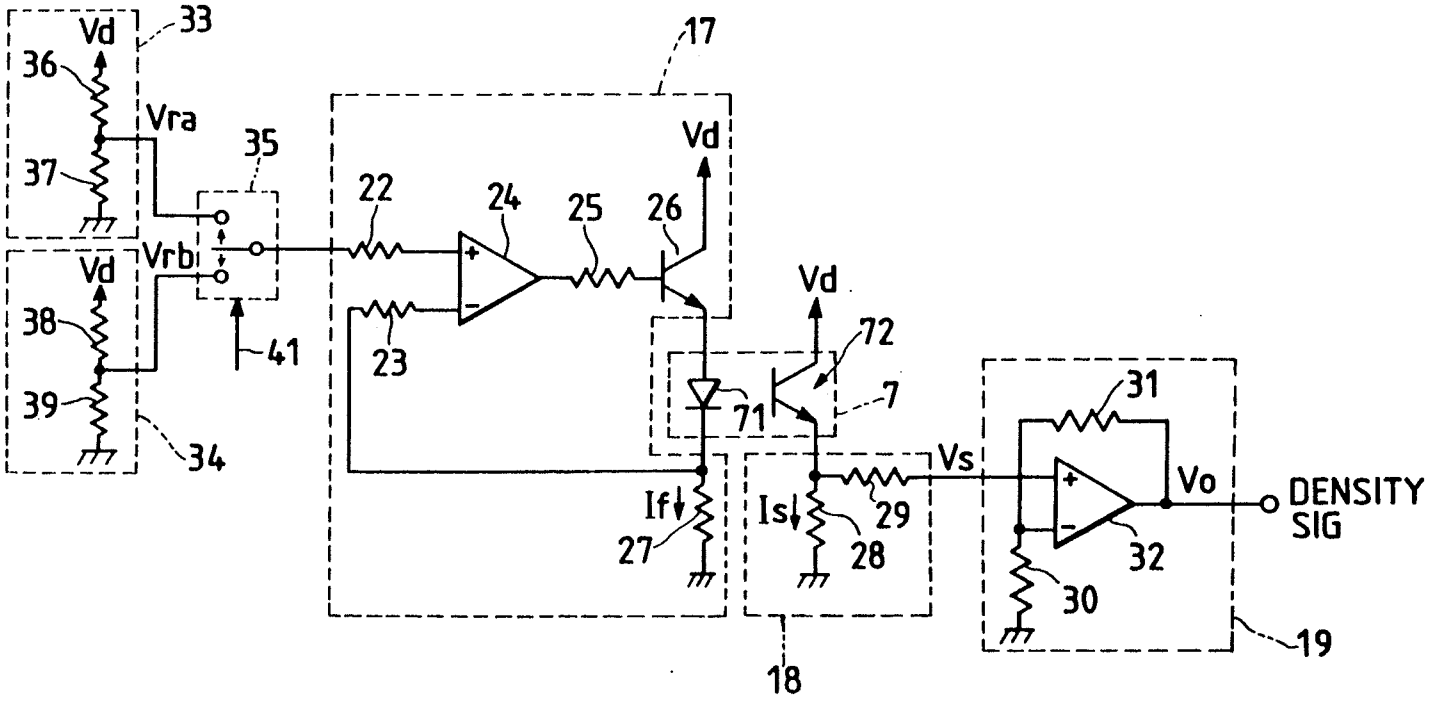
FIG. 2 is a schematic circuit diagram of the density measuring unit shown in FIG. 1.
Figure 3A:
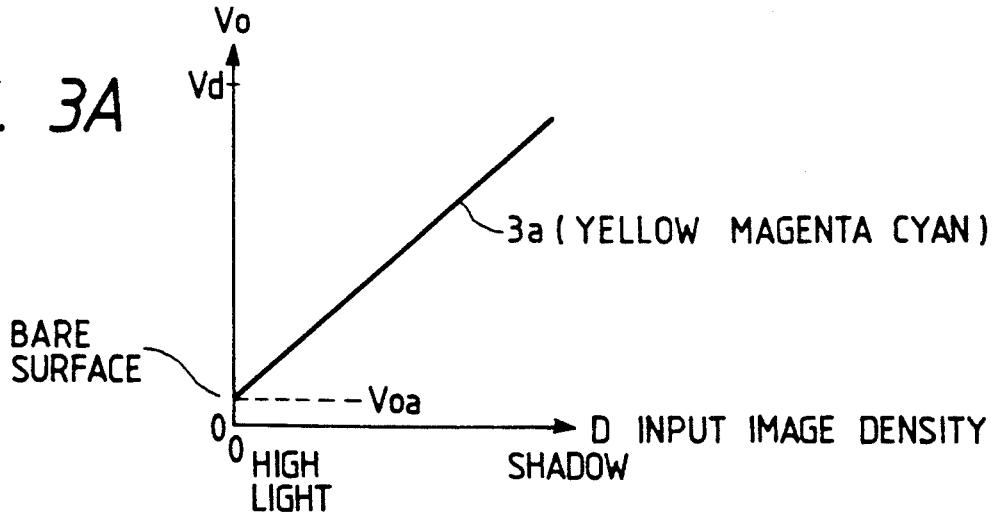
FIG. 3A is a graph showing relations between densities of input images of primary colors and output voltages of the density measuring unit shown in FIG. 1.
Figure 3B:
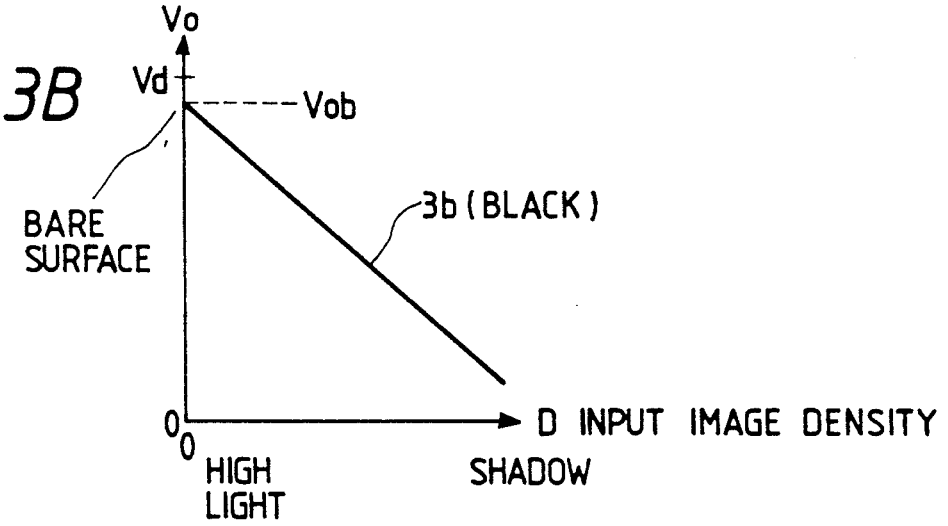
FIG. 3B is a graph showing a relation between a density of input images of the achromatic color and the output voltage of a density signal of the density measuring unit shown in FIG. 1.
Figure 4:
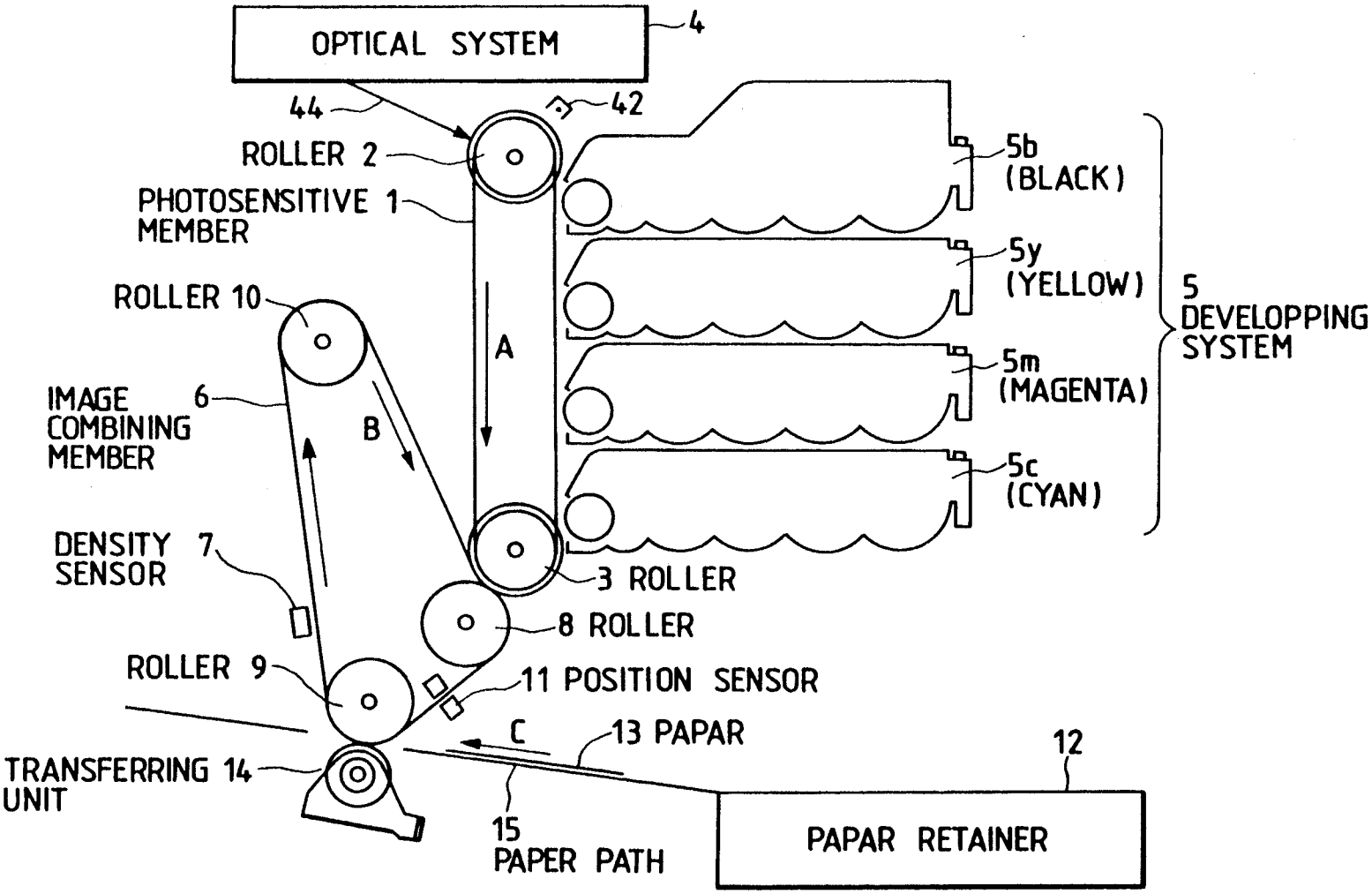
FIG. 4 is a side view of the color image formation apparatus with density measurement of this invention for showing a general structure which is common to the prior art described in this specification.
Figure 6:
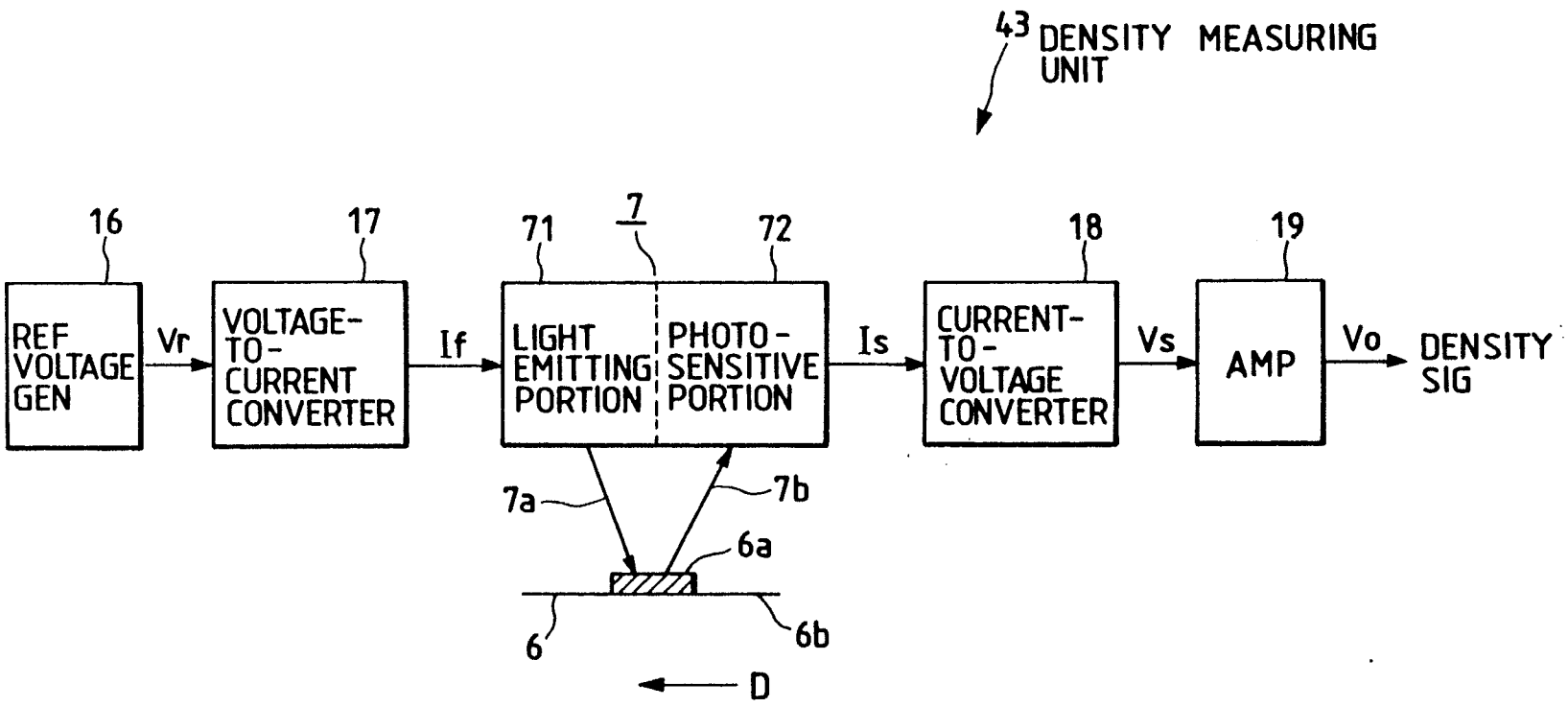
FIG. 6 PRIOR ART
FIG. 6 is a block diagram of a prior art density measuring unit for measuring a reflective density of a portion of image formed on the combining member 6.
Figure 7:
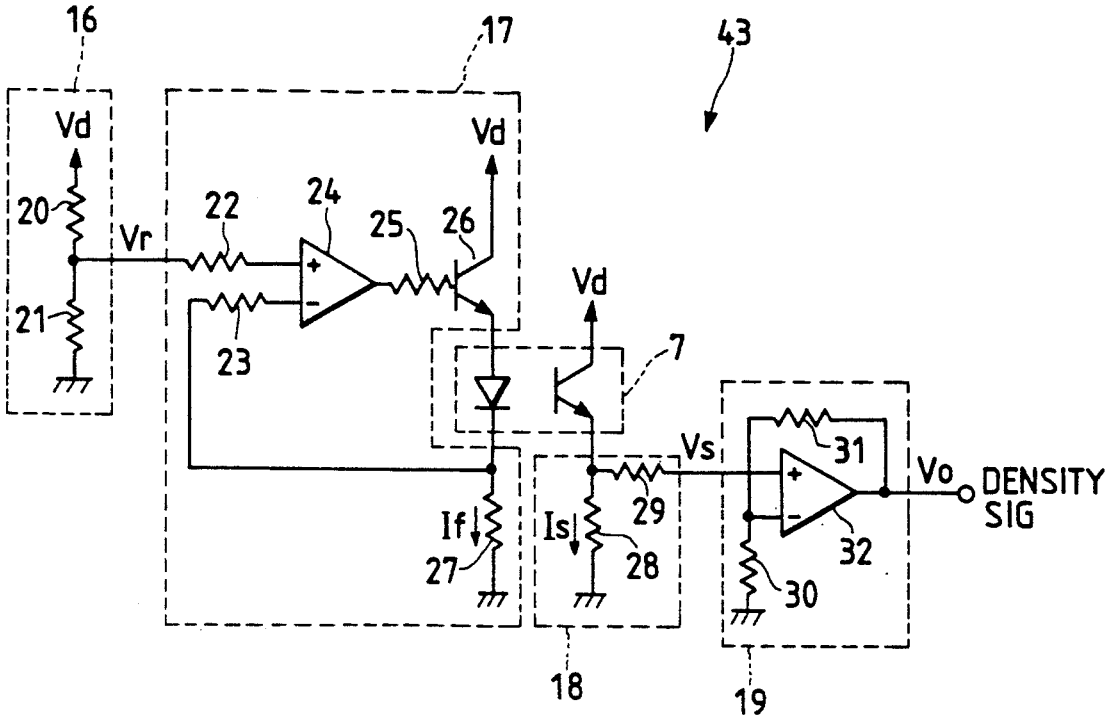
FIG. 7 PRIOR ART
FIG. 7 is shows the schematic diagram of the prior art density measuring unit.
Figure 8:
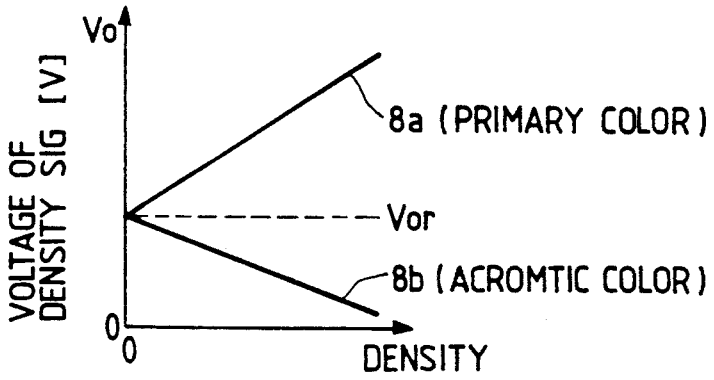
FIG. 8 PRIOR ART
FIG. 8 shows the relation of a prior art between the density of input image signal and the voltage of the density signal.

FIG. 4 is a side view of the color image formation apparatus with density measurement of this invention for showing a general structure which is common to the prior art described in this specification. FIG. 1 is a block diagram of a density measuring unit 45 of this embodiment for measuring a reflective density of a portion of an image formed on the combining member 6. FIG. 2 is a schematic circuit diagram of the density measuring unit shown in FIG. 1. FIG. 3A is a graph showing relations between densities of input images of primary colors and output voltages of the density measuring 45 unit shown in FIG. 1. FIG. 3B is a graph showing a relation between a density of input images of the achromatic color and the output voltage of a density signal of the density measuring 45 unit shown in FIG. 1.

In FIG. 4, a control unit 50 controls respective portions of this image formation apparatus. A photosensitive member 1 having an endless belt shape is supported between rollers 2 and 3 with a suitable tension and circulated in the direction shown by an arrow A in response to one of drive control signals 54 generated by the control unit 50. An optical system 4 forms consecutively forming primary color images, such as yellow, magenta, and cyan, and an achromatic image, such as a black onto the photosensitive member 1 through electrophotographic process. During formation of each of primary color and achromatic color images, the photosensitive member 1 circulates and the optical system 4 scans a surface of the photosensitive member 1 with a light beam 44 and forming each of primary color images and the black image on the photosensitive member 1 in phase with circulation of the photosensitive member 1 in response to one of drive control signals 54 generated by the control unit 50. A charger 42 charges the photosensitive member 1 prior to exposure of each of primary color and achromatic (black) images in response to one of charging control signals 53 generated by the control unit 50. A developing system 5, having yellow, magenta, cyan, and black developers 5*y*, 5*m*, 5*c* and 5*b*, consecutively develops primary color images of yellow, magenta, cyan, and black image using colorants, such as toners from electrostatic latent images formed on the photosensitive member 1. An image combining member 6 having an endless belt shape is supported by roller 8, 9, and 10 with a suitable tension. The image combining member 6 is circulated in the direction shown by an arrow B in response to one of drive control signals 54 generated by the control unit 50 and its portion is contacted with a portion of the photosensitive member 1 to receive each of developed primary color and black images from the photosensitive member 6. The image combining member 6 combines primary color and black images by consecutively receiving the developed primary color and black images and transfer the combined color image to a paper 13.

It is possible to form a color image by combining primary color images, such as yellow, magenta, and cyan. However, generally, in order to improve a picture quality of the color image, a black image is added to the color image formed by combining primary color images.

A density sensor 7 measures a density of a portion of a color image formed on the image combining member 6 by emitting an illumination light and receiving a reflected light from the image combining member 6. The image combining member 6 has an intermediate reflectivity between those of colorants of primary colors and the achromatic color, i.e., black with respect to the emitted illumination light. A position sensor 11 detects position of the image combining member 6 with reference markers, for example holes provided to the image combining member 6 for generating position signals of the image combining member 6, that is, an index signal and an equi-distance positional signal. The image combing member 6 combines primary color images and a black image with reference to the position signals to match positions of the primary color images and the black image to reduce positional deviation. A paper 13 for recording is transported in the direction shown by an arrow C from a paper retainer 12 to a contacting portion between the roller 9 and a transferring unit 14 through a paper path 15. In operation, the charger 42 charges the photosensitive member 1 in response to one of charging control signals 53 and then, the optical system 4 exposes the photosensitive member 1 to form one of primary color and achromatic color images, for example yellow, thereon with circulation of the photosensitive member 1. A corresponding developer of the developers 5*y*, 5*m*, 5*c*, and 5*b*, develops the electrostatic latent image. For example the corresponding developer 5*y* develops a yellow image. Then, the yellow image is transferred to the image combining member 6 from the photosensitive member 1. In the next cycle of formation of each of images, the charger 42 charges the photosensitive member 1 again and the optical system 4 exposes the next image onto the photosensitive member, for example a magenta image is exposed. The magenta image is developed as similar to the yellow image and then transferred to the image combining member 6 where the yellow image has been formed. Cyan and black images are consecutively formed and combined on the image combining member 6. The combined color image is transferred to the paper 3 with the transferring unit 14. The order of formations of primary colors and achromatic color (black) is predetermined in consideration of the quality of the formed color image or the like.

The density measuring unit 45 including the density sensor 7 measures a portion of each of primary color and black images formed on the image combining member 6.

Figure 5:
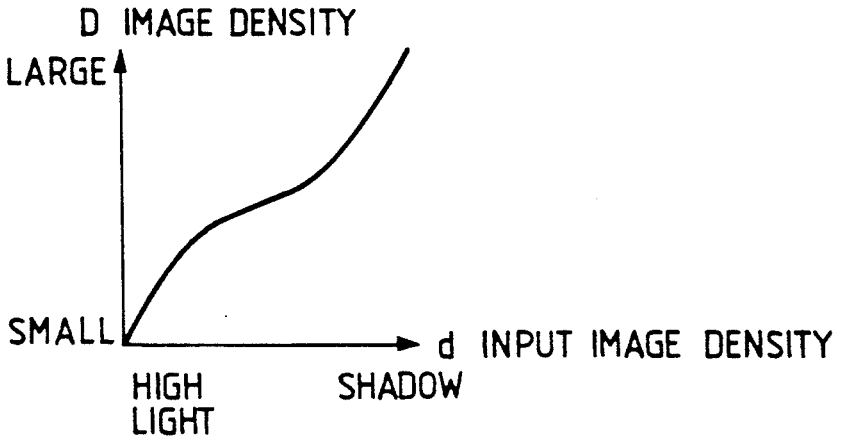
FIG. 5 is a graph showing such a $\gamma$ characteristic, which is common to the prior art described in this specification.

Generally, the electrophotographic processing, or zerography processing is subjected to the variation of the circumstances, such as the ambient temperature, humidity, or the like, so that difference in density of hue is developed in the output image though the same picture image is formed. Moreover, each of primary color images and the achromatic image has each $\gamma$ characteristic, so that the difference in density or hue is developed by the variation of the circumstance. FIG. 5 is a graph showing such a $\gamma$ characteristic, which is common to the prior art.

Therefore, it is possible to obtain a more stable output picture images by compensating the $\gamma$ characteristics of respective primary color and achromatic color images against the variation of the circumstance by changing a voltage of charger 42, an intensity of light beam 44 or the like. The density measuring unit 45 is provided for detecting the density of a portion of the image combining member 6 in order to obtain the $\gamma$ characteristics and to compensate the quality of the output picture image.

Figure 9:
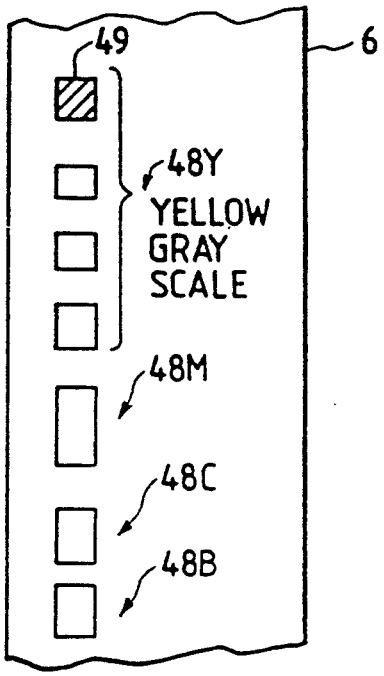
FIG. 9 is a schematic diagram of this embodiment showing an arrangement of color gray scales formed on the image combining member 6.

FIG. 9 is a schematic diagram of this embodiment showing an arrangement of color gray scales formed on the image combining member 6. The control unit 50 including a microprocessor generates gray scale signals 55 of primary and achromatic color components in response to the position signals from the position sensor 11 and exposes the photosensitive member 1 with the light beam 44 to form gray scales of primary color and achromatic color components on the image combining member 6 at respective circular position, i.e., vertical positions as shown in FIG. 9. In FIG. 9, numeral 49 is a bare portion of the image combining member 6 to provided a reference density. Numerals 48*y*, 48*m*, 48*c*, and 48*b* denote gray scales of yellow, magenta, cyan, and black. Then, the control unit 50 detects or samples a density signal of the density measuring unit 43 to measure the density of the formed gray scales 48*y*, 48*m*, 48*c*, and 48*b* in response to the position signals from the position sensor 11.

The density measuring unit 45 comprises a first reference voltage generator 33 for generating a first reference voltage Vra used for detecting densities of primary color images, a second reference voltage generator 34 for generating a second reference voltage Vrb used for detecting a density of achromatic color image, a voltage-to-current converter 17 for converting the reference voltage to a reference current If, a switch circuit 35 for selecting and sending either of the reference voltages Vra and Vrb to the voltage-to-current converter 17, a light emitting portion 71 of the density sensor 7 for emitting the illumination light 7*a* to a portion of the image combining member 6, a photosensitive portion 72 of the density sensor 7 for receiving a light 7*b* reflected at the image combining member 6 and producing a current signal Is in accordance with an intensity of the received light, a current-to-voltage converter 18 for converting the current signal Is to a voltage signal Vs, and an amplifier 19 for outputting a density signal Vo.

The first reference voltage generator 33 generates the reference voltage Vra which determines the intensity of the reference current If for controlling a brightness of the illumination light 7*a* in order to determine the most shadow point Voa shown in FIG. 3A for primary color images at a bare portion of the image combining member 6. The shadow point is determined by a gain of the amplifier 19 and the like. The second reference voltage generator 34 generates the reference voltage Vrb which determines the intensity of the reference current If for controlling a brightness of the illumination light 7*a* such that the most shadow point exists within the range as shown in FIG. 3A and the most high light point Vob is determined by the gain of the amplifier 19 in consideration of the shadow point of the primary color. The switch circuit 35 selects and sends either of the reference voltages Vra and Vrb to the voltage-to-current converter 17 in response to an intensity control signal 41 produced by the control unit 50. The voltage-to-current converter 17 converts either of the reference voltages Vra or Vrb to a reference current If. The density sensor has the light emitting portion 71 and the photo-sensitive portion 72 in one. The light emitting portion 71 emits the illumination light *7a* to a portion of the combining member 6. The image combining member 6 moves in the direction shown by an arrow D, so that when the illumination light *7a* hits a shadow portion *6a* of a gray scale, the photosensitive portion 72 receives the light reflected by the portion *6a* of the gray scale. When the illumination light *7a* hits a bare portion *6b* of the image combining member 6, the photosensitive portion 72 receives the light reflected by the image combining member 6. When the other intermediate density portion of the gray scale is illuminated, a portion of the illumination light is reflected by the colorant and the other portion of the illumination light is reflected by the surface of the image combining member 6. Therefore, the photosensitive portion 72 of the density sensor 7 detects the reflective density at the image combining member 6 by representing the reflective density with the current signal Is. The current-to-voltage converter 18 converts the current signal Is to a voltage signal Vs. The amplifier 19 outputs a density signal Vo to the control unit 50 to detect the $\gamma$ characteristics.

FIG. 2 shows the schematic diagram of the density measuring unit 45. The first reference voltage generator 33 comprises resistors 36 and 37 for dividing the supply voltage Vd to generate the first reference voltage Vra. The second reference voltage generator 34 comprises resistors 38 and 39 for dividing the supply voltage Vd to generate the second reference voltage Vrb. The switch circuit 35 selects and sends either of the reference voltages Vra and Vrb to the voltage-to-current converter 17 in response to the intensity control signal 41 produced by the control unit 50. The voltage-to-current converter 17 comprises resistors 22, 23, 25, and 27, an operational amplifier 24, and a transistor 26 and determines the current signal If which is given by If=Vr/resistance of resistor 27. The light emitting portion 71 comprises a light emitting diode (LED) for emitting the illumination light *7a* of an infrared ray. The photosensitive portion 72 comprises a phototransistor having a maximum sensitivity at the infrared region. That is, the photosensitive portion 72 can detects the illumination light from the LED 71. The colorant of primary color images, that is, primary color toners have higher reflectivity than that of the toner of the achromatic color. The bare surface of the image combining member 6 has an intermediate reflectivity between the primary color toners and the black toner with respect to the illumination light *7a* of the infrared ray. The current signal If determines the intensity of the illumination light *7a*.

The current-to-voltage converter 18 comprises resistors 28 and 29 outputs the voltage signal Vs given by Vs=Is×a resistance of the resistor 28. The amplifier 19 comprises resistors 30 and 31, and an operational amplifier 32 and outputs the density signal given by Vo=(1+resistance of the resistor 31/resistance of the resistor 30)×Vs.

The determination of the reference voltage Vra and Vrb and the reflectively of the image combining member 6 is described more specifically as follows:

The colorant of primary color images, that is, primary color toners have higher reflectivity that of the image combining member 6 and the toner of the achromatic color is lower than that of the image combining member 6. That is, the bare surface of the image combining member 6 has the intermediate reflectivity between the primary color toners and the black toner with respect to the illumination light *7a* of the infrared ray. Therefore, the intensity of the reflected light increases with the amount of the primary color toner per a unit area. Thus, the measurement of density of primary color toners, the intensity of the illumination light *7a* is set to a lower value than that for the achromatic color (black toner) so that the light reflected by a bare surface of the image combining member 6 shows an output voltage of the density signal near zero volt, or the ground level. That is, the first reference voltage Va is set to Voa as shown in FIG. 3A. Then, the resistances of the resistors 28 and 31 are determined to obtain a suitable range as shown by a curve *3a*. That is, the first reference voltage Vra is set to be relatively low. Therefore, the current signal If is relatively low, so that the intensity of the illumination light *7a* becomes relatively low. Accordingly, the intensity of the reflected light *7b* increases from a high light to a shadow point as shown in FIG. 3A.

The toner of the achromatic color has a lower reflectivety than the surface of the image combining member 6. Therefore, the intensity of the reflected light decreases with the amount of the achromatic color toner per a unit area. Thus, for the measurement of density of achromatic color toner, the intensity of the illumination light *7a* is set to a higher value than that for the primary color toners so that the light reflected by a bare surface *6a* of the image combining member 6 shows an output voltage of the density signal near the upper limit of the dynamic range. That is, the first reference voltage Va is set to Vob as shown in FIG. 3A. Then, the resistances of the resistors 28 and 31 are determined to obtain a suitable range as shown by a curve *3b*. That is, the second reference voltage Vra is set to be low. Therefore, the current signal If is high, so that the intensity of the illumination light *7a* becomes high. Accordingly, the intensity of the reflected light *7b* decreases from a high light to a shadow point as shown in FIG. 3B.

In other words, each of the colorants of primary color has a characteristic such that the more shadow or larger amount of colorants per a unit area the more the colorant reflects light from the light emitting portion 71. On the other hand, the colorant of achromatic color has a characteristic such that the more shadow or larger amount of colorant per a unit area the more the colorant absorbs light from the light emitting portion 71.

The switch circuit 35 is switched between the first and second reference voltages in response to the intensity control signal 41 produced by the control unit 50. During the measurement of the reflective density, the control unit 50 causes the combining member 6 to circulate and causes the switch circuit 35 to select the first and second reference voltages Vra and Vrb in accordance with the positions of the gray scales of the primary colors and the achromatic color which have been formed.

The control unit 50 can obtain a higher resolution data information of $\gamma$ characteristics of primary and achromatic colors. Therefore, the control unit 50 can produces a more accurate a conversion table for compensating of characteristics of formation of images. That is, the control unit 50 changes the charging voltages of the photosensitive member 1, toners, and the like for compensation of $\gamma$ characteristics.

Figure 10:
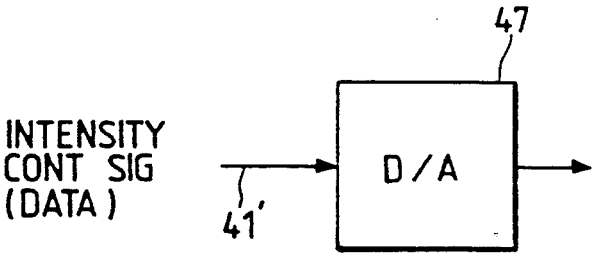
FIG. 10 is a partial block diagram of a modification of this embodiment showing such a switch circuit.

In this embodiment, the first and second reference voltages are selected by the switch circuit 35 in accordance with the cases of detection of the primary colors and achromatic color. However, it is possible that the first and second reference voltages are generated by a D/A converter to which the control units send two different data as the intensity control signal 41. That is, the intensity of the illumination light *7a* is changed in accordance with the cases of the detection of the primary colors and the achromatic color. FIG. 10 is a partial block diagram of a modification of this embodiment showing such a switch circuit. In FIG. 10, an D/A converter 47 receives the intensity control signal 41' including data indicative of the intensity of the illumination light *7a* and converts the data to a voltage signal, that is, the reference voltage signals Vra or Vrb in accordance with the received data 41'.

What is claimed is:

1. An image formation apparatus for forming a color image comprising:

an image combining member for overlapping a plurality of different mono-color images formed by an electrophotographic process with a plurality of respective different colorants to form said color image thereon;

density measuring means for measuring a reflective density at a desired portion of said color image, said density measuring means including light emitting means for emitting light toward said image combining member and photoelectric conversion means for receiving and photoelectrically-converting said light reflected at said image combining member to a density signal, wherein said plurality of colorants are divided into first and second groups, said first group of said plurality of different colorants having a higher reflectivity than said image combining member with respect to said light, a second group of said plurality of different colorants having a lower reflectivity than said image combining member; and switching means for causing said light emitting means to change an intensity of said light in response to an intensity control signal, wherein said switching means comprises first reference signal generation means for generating a first reference signal, a second reference signal generation means for generating a second reference signal, and a switch responsive to said intensity control signal for selecting either of said first and second reference signals, and wherein said light emitting means changes said intensity of said light in accordance with an output of said switch.

2. An image formation apparatus as claimed in claim 1, wherein said light emitting means comprises a light emitting diode and said switching means comprises current control means for changing an intensity of a current for driving said light emitting diode in accordance with said intensity control signal.

3. An image formation apparatus as claimed in claim 1, wherein said first group of colorants have chromatic colors and said second group of colorants have achromatic colors.

4. An image formation apparatus as claimed in claim 1, wherein said chromatic colors includes yellow, magenta, and cyan and said achromatic color includes black.

5. An image formation apparatus for forming a color image comprising:

an image combining member for overlapping a plurality of different mono-color images formed by an electrophotographic process with a plurality of respective different colorants to form said color image thereon;

density measuring means for measuring a reflective density at a desired portion of said color image, said density measuring means including light emitting means for emitting light toward said image combining member and photoelectric conversion means for receiving and photoelectrically-converting said light reflected at said image combining member to a density signal, wherein said plurality of colorants are divided into first and second groups, said first group of said plurality of different colorants having a higher reflectivity than said image combining member with respect to said light, a second group of said plurality of different colorants having a lower reflectivity than said image combining member; and switching means for causing said light emitting means to change an intensity of said light in response to an intensity control signal, wherein said intensity control signal comprises digital data and said switching means comprises a digital-to-analog converter responsive to said intensity control signal for causing said light emitting means to change said intensity of said light in accordance with a value of said digital data of said intensity control signal.

6. An image formation apparatus for forming a color image, having an image combining member for overlapping a plurality of different mono-color images formed by an electrophotographic process with a plurality of respective different colorants to form said color image thereon and density measuring means for measuring a reflective density at a desired portion of said color image, said density measuring means having light emitting means for emitting light toward said image combining member and photoelectric conversion means for receiving and photoelectrically-converting said light reflected at said image combining member to a density signal, said plurality of colorants being divided into first and second groups, said first group of said plurality of different colorants having a higher reflectivity than said image combining member with respect to said light, a second group of said plurality of different colorants having a lower reflectivity than said image combining member comprising:

switching means for causing said light emitting means to change an intensity of said light between first and second values an intensity control signal such that in response to an intensity control signal said light emitting means changes said intensity to said first value when a density of an image formed with one of colorant of said first group is measured by said density measuring means and to a second value when a density of an image formed with one of colorant of said second group is measured by said density measuring means.

7. An image formation apparatus as claimed in claim 6, wherein said switching means comprises first reference signal generation means for generating a first reference signal, a second reference signal generation means for generating a second reference signal, a switch responsive to said intensity control signal for outputting said first reference signal when said density of said image formed with one of colorant of said first group is measured by said density measuring means and for outputting said second reference signal when said density of said image formed with one of colorant of said second group is measured by said density measuring means, and a intensity control means for controlling said intensity in accordance with an output of said switch.

8. An image formation apparatus as claimed in claim 6, wherein said intensity control signal comprises digital data and said switching means comprises an digital-to-analog converter responsive to said intensity control signal for causing said light emitting means to change said intensity of said light in accordance with a value of said digital data of said intensity control signal.

9. An image formation apparatus as claimed in claim 6, wherein said light emitting means comprises a light emitting diode and said switching means comprises current control means for changing an intensity of a current for driving said light emitting diode in accordance with said intensity control signal.

10. An image formation apparatus as claimed in claim 6, wherein said first group of colorants have chromatic colors and said second group of colorants have achromatic colors.

11. An image formation apparatus as claimed in claim 6, wherein said chromatic colors includes yellow, magenta, and cyan and said achromatic color includes black.

* * * * *